US008998192B2

(12) United States Patent
Yoshida

(10) Patent No.: US 8,998,192 B2
(45) Date of Patent: Apr. 7, 2015

(54) SHEET PUNCHING DEVICE AND IMAGE FORMING SYSTEM

(71) Applicant: Hiroki Yoshida, Aichi (JP)

(72) Inventor: Hiroki Yoshida, Aichi (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/777,277

(22) Filed: Feb. 26, 2013

(65) Prior Publication Data

US 2013/0228089 A1 Sep. 5, 2013

(30) Foreign Application Priority Data

Mar. 2, 2012 (JP) ..... 2012-046241

(51) Int. Cl.

| | |
|---|---|
| ***B26F 1/02*** | (2006.01) |
| ***B26D 5/00*** | (2006.01) |
| ***B26D 7/01*** | (2006.01) |
| ***B26F 1/00*** | (2006.01) |

(52) U.S. Cl.

CPC ... *B26F 1/02* (2013.01); *B26D 5/00* (2013.01); *B26D 7/015* (2013.01); *B26F 1/0092* (2013.01)

(58) Field of Classification Search

USPC ..... 270/58.01, 58.02, 58.07; 83/79, 80, 83/209, 211, 360, 365, 368, 370

See application file for complete search history.

(56) References Cited

U.S. PATENT DOCUMENTS

| | | | | |
|---|---|---|---|---|
| 6,606,928 | B2 * | 8/2003 | Takaishi et al. | 83/210 |
| 6,783,124 | B2 * | 8/2004 | Tamura et al. | 270/58.07 |
| 7,520,497 | B2 * | 4/2009 | Moriyama et al. | 270/58.07 |
| 8,011,649 | B2 * | 9/2011 | Yahata et al. | 270/58.07 |
| 8,016,280 | B2 * | 9/2011 | Iguchi et al. | 270/58.07 |
| 8,042,796 | B2 * | 10/2011 | Iguchi | 270/58.07 |
| 2007/0057441 | A1 | 3/2007 | Tsutsui et al. | |
| 2007/0138730 | A1 | 6/2007 | Tsutsui et al. | |
| 2010/0025910 | A1 | 2/2010 | Nakayama | |

FOREIGN PATENT DOCUMENTS

| | | |
|---|---|---|
| JP | 3363725 | 10/2002 |
| JP | 4478595 | 3/2010 |

* cited by examiner

*Primary Examiner* — Leslie A Nicholson, III
(74) *Attorney, Agent, or Firm* — Harness, Dickey & Pierce, P.L.C.

(57) ABSTRACT

In the invention, for a first sheet, regardless of the sheet size (width), a lateral registration detector is moved in a direction towards an edge face of the sheet from a home position to detect the edge face of the sheet. With lateral deviation in the sheet position corrected, punching is performed by a puncher. For the second and subsequent sheets, the lateral registration detector is moved in advance to near the edge face of the sheet with reference to the detected position of the sheet edge of the first sheet, and the edge face is detected at a given timing. With lateral deviation in the sheet position corrected, punching is performed by the puncher.

10 Claims, 6 Drawing Sheets

SHEET PUNCHING DEVICE AND IMAGE FORMING SYSTEM

CROSS-REFERENCE TO RELATED APPLICATIONS

The present application claims priority to and incorporates by reference the entire contents of Japanese Patent Application No. 2012-046241 filed in Japan on Mar. 2, 2012.

BACKGROUND OF THE INVENTION

1. Field of the Invention

The present invention relates to a sheet punching device that is integrally provided on or annexed to, or separately provided to an image forming apparatus such as a printer, a copying machine, and a facsimile and that performs punching on a recording medium (sheet) discharged from the image forming apparatus, and an image forming system provided with the sheet punching device.

2. Description of the Related Art

A punching unit that punches sheets one by one is currently used, as a unit to punch sheets conveyed from an image forming apparatus, in a post-processing apparatus. The punching unit of this type punches the conveyed sheets one by one, and is advantageous in terms of load required for punching being reduced and its productivity.

When the position of a sheet at the time of punching is not good, for example, badly skewed or lateral registration being badly displaced, the position of punched hole is misaligned, and thus alignment accuracy of the hole deteriorates. To prevent this, a method has been developed in which the skew of a sheet is corrected and punching is performed by further reading an edge portion on one side of the sheet in a direction orthogonal to a conveying direction of the sheet and by correcting the deviation based on that information so as to improve accuracy of the hole position.

More specifically, a punching device according to the invention disclosed in Japanese Patent No. 3363725 includes a punching unit that is movable in the direction intersecting the conveying direction of sheets and is provided with a puncher for punching a sheet in a direction intersecting the conveying direction of the sheet, a lateral registration detector to detect an edge portion of the sheet on one side parallel to the conveying direction of the sheet conveyed to the punching unit, and a moving unit for moving a punching position of the punching unit in the direction intersecting the sheet conveying direction based on positional information of the side edge portion of the sheet detected by the lateral registration detector. In this device, the lateral registration detector is moved in advance to near the side edge portion of the sheet based on size information of the sheet conveyed, and detects the side edge portion of the sheet on one side parallel to the conveying direction of the sheet conveyed. The punching unit is moved to a punching position based on the positional information of the side edge portion of the sheet. Accordingly, the punching position of the sheet can be aligned with the edge portion on one side of the sheet. Furthermore, even when an apparatus that outputs sheets conveys sheets in a laterally displaced manner, lateral deviation is continuously detected by the lateral registration detector and the punching unit is moved to an appropriate punching position. The sheets can be punched continuously without compromising the processing speed (image forming speed) of a sheet output apparatus, for example, an image forming apparatus.

In the invention disclosed in Japanese Patent No. 4478595, a sheet punching device that punches sheets and is mounted in a post-processing apparatus for conveying the sheets in a center-based manner includes a detector that detects a sheet position, a correcting unit that corrects lateral deviation in the sheet position, and a controller. The correcting unit includes a punching unit that is movable in a width direction of sheet. The controller controls the first sheet to be punched at a reference position in the center-based conveyance and controls the second and subsequent sheets to be punched by detecting a difference in lateral deviation from the first sheet with reference to the sheet position of the first sheet detected by the detector and by moving the punching unit for the extent of the difference such that the positions of holes on the sheets overlap with one another regardless of the positional deviation of the sheets themselves. Accordingly, the punching can be performed at the same position of each sheet although it may not be at the center of the sheet, and the accuracy of punching holes of sheet can be increased.

The technology to improve accuracy of the hole position in which the skew of a sheet is corrected and punching is performed by further reading an edge portion on one side of the sheet in a direction orthogonal to the sheet conveying direction and by correcting the deviation based on that information is already known.

Sheet skew and lateral registration may arise from how sheets are set on a paper feed tray. When the sheets are set on the near side than the center of the paper feed tray, the sheets are displaced towards the near side. When sheets are set on the back side than the center of the paper feed tray, the sheets are displaced towards the back side. Deviation occurs in the same direction for each sheet. Furthermore, curling and shrinkage of sheets, and sheet skew and lateral registration attributable to an assembling condition of a machine tend to occur in the same direction on the same machine.

In the technology disclosed in Japanese Patent No. 3363725, the detector is moved in advance to near the sheet edge for each sheet based on the sheet size (width) information notified from the image forming apparatus. When the actual sheets are continuously displaced in a direction far from the detector than the center of layout, it is necessary to move the detector for a useless distance each time, whereby the power to move the lateral registration detector is wasted.

Furthermore, in the technology disclosed in Japanese Patent No. 4478595, the first sheet is punched as the sheet is assumed to be positioned at the center of the layout regardless of its actual position, and the second and subsequent sheets are punched by correcting only for the extent of deviation from the first sheet in a main scanning direction. When the actual sheet position is largely displaced from the center of the layout, the punching position is displaced from the center of the sheet, whereby the sheets may not look good and the edges of the sheets may stick out from a file when filed.

There is needed to provide a sheet punching device in which, without causing an increase in the size and complexity of the device or compromising the output speed of sheets (speed of the image forming process), punching can be performed by aligning the hole position with respect to a side edge of a sheet and the power to move the lateral registration detector is not wasted as much as possible, and an image forming system provided with the sheet punching device.

SUMMARY OF THE INVENTION

It is an object of the present invention to at least partially solve the problems in the conventional technology.

According to the present invention, there is provided: a sheet punching device comprising a punching unit configured to perform punching on a sheet; a sheet edge detector configured to detect an edge portion of the sheet in parallel with a conveying direction of the sheet; and a moving unit configured to move the punching unit and the sheet edge detector each in a direction intersecting the sheet conveying direction.

In the above-mentioned sheet punching device, in an operation of detecting an edge portion of a sheet when the punching unit performs the punching on the sheet, the sheet edge detector is moved in a direction towards the sheet from a home position at a given timing and is caused without pause to detect an edge portion of a first sheet, and the sheet edge detector is moved in advance to near a sheet edge portion with reference to a detected position of the sheet edge portion of the first sheet at a given timing, and the sheet edge detector is further moved at a given timing and is caused to detect an edge portion of second and subsequent sheets.

The present invention also provides an image forming system comprising an image forming apparatus, a post-processing apparatus, and a sheet punching device between the image forming apparatus and the post-processing apparatus, wherein the sheet punching device comprises a punching unit configured to perform punching on a sheet, a sheet edge detector configured to detect an edge portion of the sheet in parallel with a conveying direction of the sheet, and a moving unit configured to move the punching unit and the sheet edge detector each in a direction intersecting the sheet conveying direction.

In the above-mentioned sheet punching device included in the image forming system, in an operation of detecting an edge portion of a sheet when the punching unit performs the punching on the sheet, the sheet edge detector is moved in a direction towards the sheet from a home position at a given timing and is caused without pause to detect an edge portion of a first sheet, and the sheet edge detector is moved in advance to near a sheet edge portion with reference to a detected position of the sheet edge portion of the first sheet at a given timing, and the sheet edge detector is further moved at a given timing and is caused to detect an edge portion of second and subsequent sheets.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

With reference to the accompanying drawings, an exemplary embodiment of the present invention will be described hereinafter. The present embodiment features the following when controlling detection of one edge portion of a sheet by a lateral registration detector as a sheet edge detector and moving a puncher as a punching unit to an appropriate punching position. For the first sheet, regardless of the sheet size (width), the lateral registration detector is moved in a direction towards an edge face of the sheet from the home position to detect the edge face of the sheet. With lateral deviation in the sheet position corrected, punching is performed by the puncher. For the second and subsequent sheets, the lateral registration detector is moved in advance to near the edge face of the sheet with reference to the detected position of the sheet edge of the first sheet, and the edge face is detected at a given timing. With lateral deviation in the sheet position corrected, punching is performed by the puncher.

Figure 1:
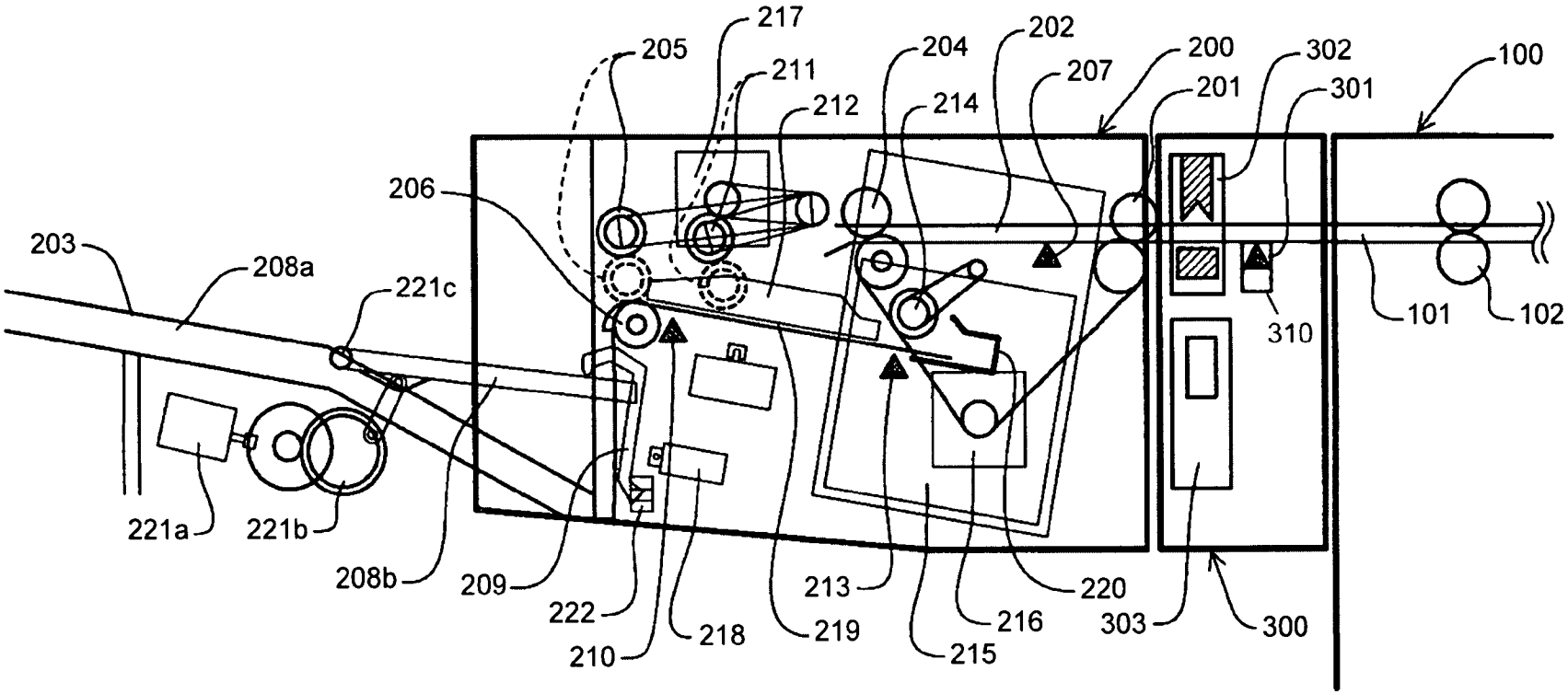
FIG. 1 is a schematic diagram illustrating a configuration of a relevant portion of an image forming system according to an embodiment.

FIG. 1 is a schematic diagram illustrating the configuration of a relevant portion of an image forming system according to the embodiment. The image forming system in the embodiment is constructed by an image forming apparatus 100, a post-processing apparatus 200, and a punch unit 300 as a sheet punching device of the invention.

The image forming apparatus 100 is provided with a discharge conveying path 101 to convey a sheet on which processes of image transfer, fixing, and others are performed, and a pair of discharge conveying rollers 102. The post-processing apparatus 200 is mainly constructed by, from the upstream side in a sheet conveying direction, a pair of entrance rollers 201, a discharge conveying path 202, a pair of shift conveying rollers 204, a staple tray 219, a tapping roller 211, a return roller 214, a trailing-end reference fence 220, jogger fences (alignment plates) 212, a pair of discharging rollers 206, and a discharge tray 203. The punch unit 300 is arranged between the image forming apparatus 100 and the post-processing apparatus 200, and is mainly constructed by a lateral registration detector 301 as a sheet edge detector, a puncher 302 as a punching unit, and a punch waste storage 303. The lateral registration detector 301 and the puncher 302 are configured to move in a direction perpendicular to the sheet conveying direction by respective driving sources not depicted.

On a sheet conveyed from the image forming apparatus 100, punching is performed by the punch unit 300, and the sheet punched is discharged to the post-processing apparatus 200. At a sheet receiving portion of the post-processing apparatus 200, provided are the pair of entrance rollers 201 that receives the sheet from the discharge conveying path 101 and the pair of discharge conveying rollers 102 of the image forming apparatus 100 via the punch unit 300, the discharge conveying path 202 through which the sheet received is conveyed towards the pair of shift discharging rollers 204 side, and the pair of shift discharging rollers 204 that has a function to discharge sheets to the discharge tray 203 by shifting the sheets. By the rotation of the pair of entrance rollers 201 and the pair of shift discharging rollers 204 by an entrance motor 216, the sheets are conveyed along the discharge conveying path 202.

In the discharge conveying path 202, an entrance sensor 207 is arranged to detect the leading end and the trailing end of a sheet, and based on the detected timings of the leading end and the trailing end of the sheet detected and the number of driving steps of the entrance motor 216 and a discharging motor 217 that are of stepping motors, the timings to perform respective sheet processing are determined.

The following operations are different between a shift mode in which sheets are shifted and discharged and a staple mode in which a plurality of sheets are stapled and discharged. Accordingly, each of the sheet-passing modes will be described with additional description of the configuration of respective units.

Shift Mode Operation

The shift mode is a mode in which, when discharging sheets, a discharged position of the sheets is shifted in a direction perpendicular to the sheet conveying direction for each given number of sheets so as to sort the sheets by the shifting. The direction perpendicular to the sheet conveying direction is a direction intersecting the sheet conveying direction, and is the direction perpendicular to the plane of FIG. 1 (width direction). The same applies hereinafter.

The pair of shift discharging rollers 204 is provided at the most downstream end of the discharge conveying path 202, and is driven to reciprocate in a direction perpendicular to the sheet conveying direction by a shift motor not depicted. More specifically, when sorting sheets in the shift mode, the pair of shift conveying rollers 204 moves in the direction perpendicular to the sheet conveying direction for each given number of sheets, and discharges the sheets to the discharge tray 203 by shifting the conveying direction of the sheet for the extent of the move in the perpendicular direction. Accordingly, when the sheets are stacked on the discharge tray 203, the discharged positions of the sheets are alternately shifted for each given number of sheets, whereby the sorting of sheets is performed.

At the downstream of the pair of shift conveying rollers 204, a discharge guiding plate 205 and the pair of discharging rollers 206 are arranged. The pair of discharging rollers 206 is driven by the discharging motor 217, and the discharge guiding plate 205 is movable in an up-and-down direction by a stepping motor not depicted. By the pair of discharging rollers 206 and a driven roller attached to the discharge guiding plate 205, a sheet is clamped and conveyed, and is then discharged to and placed on the discharge tray 203.

At an attaching portion of the discharge tray 203 attaching to the main body of the post-processing apparatus 200, a sheet presser 209 is arranged to press the sheets placed on the discharge tray 203, and by an on-and-off operation of a solenoid 218, a sheet-press releasing action or a sheet pressing action is performed. More specifically, coordinating with the conveyance of a sheet, the solenoid 218 is turned on to release the pressing action of the sheet presser 209, and when the sheet passes through the pair of discharging rollers 206, the solenoid 218 is turned off to perform the sheet pressing action.

The discharge tray 203 is provided with a fixed tray portion 208*a* on the downstream side in the conveying direction and a movable tray portion 208*b* on the upstream side, and the movable tray portion 208*b* is moved up and down by a tray DC motor 221*a* and a cam link mechanism 221*b*. The movable tray portion 208*b* is pivotally supported on the fixed tray portion 208*a* via a spindle 221*c* to swing with the end of the movable tray portion 208*b* on the downstream side as a turning end, and an actuating end of the cam link mechanism 221*b* is coupled to the movable tray portion 208*b*. Accordingly, when the tray DC motor 221*a* rotates, the movable tray portion 208*b* swings about the spindle 221*c* as the center in response to the rotation.

When the number of sheets discharged reaches a given number, by a command from a controller, the tray DC motor 221*a* rotates and a free end of the movable tray portion 208*b* is lowered. On the sheet presser 209, a tray sheet-plane detecting sensor 222 is arranged. When the tray sheet-plane detecting sensor 222 is off in a condition of the sheet presser 209 pressing the sheets, the discharge tray 203 is raised until the tray sheet-plane detecting sensor 222 turns on. When the tray sheet-plane detecting sensor 222 is on, the discharge tray 203 is once lowered until the tray sheet-plane detecting sensor 222 turns off, and is then raised until it turns on again. This makes the height of the discharge tray 203 on which the sheets are placed constant.

Accordingly, the free end of the movable tray portion 208*b* is raised and lowered in response to the stacking condition of sheets on the discharge tray 203 to keep the distance from a nip portion of the pair of discharging rollers 206 to a sheet stacking portion of the movable tray portion 208*b* constant. This allows a contact angle of the sheet discharged from the pair of discharging rollers 206 on the movable tray portion 208*b* to be constant, whereby the alignment quality of sheets stacked on the discharge tray 203 can be stabilized and a large number of sheets can be stacked.

By repeating the above-described operation, the sorted sheets are stacked on the discharge tray 203.

Staple Mode Operation

The staple mode is a mode in which, when discharging sheets, the sheets are stapled and discharged for each given number of sheets.

Between the pair of shift conveying rollers 204 provided at the most downstream end of the discharge conveying path 202 and the discharge guiding plate 205 provided immediately before discharging to the discharge tray 203, provided is the tapping roller 211 driven in an up-and-down direction by the stepping motor not depicted. The tapping roller 211 is composed of a lever portion that moves up and down and a roller portion, and the roller portion is driven to rotate in a counter direction to the sheet conveying direction by the discharging motor 217.

In the staple mode, at the timing of the trailing end of a sheet passing through the pair of shift conveying rollers 204, the tapping roller 211 is lowered, and by the roller portion thereof, the sheet is pressed to the staple tray 219, and the roller portion is then rotated to switchback the sheet until the trailing end of the sheet abuts the trailing-end reference fence 220. The rotary drive of the roller portion of the tapping roller 211 is driven by the discharging motor 217 that is the same drive as that for the pair of discharging rollers 206. Above the trailing-end reference fence 220, provided is the return roller 214 to assist in the switchback of the sheet and to perform alignment in the sheet conveying direction. The alignment is performed with the trailing-end reference fence 220 as a reference by abutting the sheet on the trailing-end reference fence 220.

When the switchback of sheet is completed, the alignment of sheet in the direction perpendicular to the sheet conveying direction is performed by the jogger fences 212 arranged on the staple tray 219. The jogger fences 212 are composed of a fixed portion and a movable portion. The movable portion moves in the direction perpendicular to the sheet conveying direction to clamp the edge portions of the sheet with the fixed portion, and abuts the edge portion of the sheet to align the sheet at a reference position to perform the alignment.

In this process, the edge face of the trailing end of the sheet on one side is inserted up to a stapling position of staples by a stapler 215, and after the conveying operation, the switch-back operation, and the alignment operation for a specified number of sheets are completed, stapling is performed.

After the stapling, the discharge guiding plate 205 is lowered as indicated by a broken line in FIG. 1 to clamp a bundle of sheets with the pair of discharging rollers 206 and the driven roller attached to the discharge guiding plate 205, and by driving the discharging motor 217, the sheet bundle is discharged to the discharge tray 203. After the discharging motor 217 is driven for a given number of steps from discharging of the sheet bundle being started, the solenoid 218 is turned on to release the sheet presser 209, and the discharge tray 203 is then lowered by a constant amount.

Thereafter, at the timing of the trailing end of the sheet bundle passing over a bundle discharging sensor 210, the discharge guiding plate 205 is raised and the discharging motor 217 is stopped to be ready for receiving a subsequent sheet. At the same timing, the solenoid 218 is turned off to press the sheet bundle. The reference numeral 213 represents a sheet presence sensor that detects the presence of sheet on the staple tray 219, and is used for the detection of a remaining sheet inside when the power is turned on or a paper jam occurs.

Next, the punching performed by the punch unit 300 will be described.

First Sheet Conveying Operation

When the first sheet P1 is conveyed from the image forming apparatus 100 and the leading end of the sheet reaches the pair of discharge conveying rollers 102, the post-processing apparatus 200 makes the pair of entrance rollers 201 and the pair of shift conveying rollers 204 rotate to receive the sheet. When the sheet is further conveyed to a given position, to detect an edge portion on one side of the sheet being conveyed by a lateral registration detecting sensor 304 arranged on the lateral registration detector 301 as a sheet edge detector, the lateral registration detector 301 moves in a direction towards the sheet from the home position via a moving unit 310. The lateral registration detector 301 stops moving when the sheet edge portion is detected, and moves in a direction towards the home position. Furthermore, from positional information of the sheet edge portion detected, the amount of lateral registration (lateral deviation) is calculated, and while the sheet is conveyed, the movement of the puncher 302 to punch at the center of the sheet is further calculated. The puncher 302 is then moved from the home position to the punching position calculated via the moving unit 310.

When the sheet is further conveyed and the trailing end of the sheet reaches a given position, the pair of entrance rollers 201 and the pair of shift conveying rollers 204 stop rotating, i.e., the sheet is stopped, and punching by the puncher 302 is performed.

When the punching is completed, the pair of entrance rollers 201 and the pair of shift conveying rollers 204 are rotated again and the conveying of sheet is continued. The puncher 302 is returned to the home position. Subsequently, the sheet is conveyed downstream and discharged on the discharge tray 203 or on the staple tray 219 depending on the sheet-passing mode.

Second and Subsequent Sheet Conveying Operation

Next, when the second sheet is conveyed from the image forming apparatus 100 and the leading end of the sheet reaches the pair of discharge conveying rollers 102, the lateral registration detector 301 moves to near the sheet edge portion from the home position. The position of near the sheet edge portion here is calculated from the detected position of the edge portion of the first sheet, and is a standby position of the lateral registration detector 301.

When the sheet is further conveyed and the trailing end of the sheet reaches a given position, the lateral registration detector 301 moves in the direction towards the sheet from the standby position to detect the edge portion on one side of the sheet.

The subsequent operation is the same as that for the first sheet, and thus the moving and punching of the puncher 302 are performed. For the third and subsequent sheets, the same operation as that for the second sheet is performed, and is repeated until the image forming apparatus 100 stops conveying sheets or the sheet size is changed.

FIGS. 2 to 5 are plan views illustrating the punch unit 300 and portions of the apparatuses ahead and behind, and are views for explaining the operation of the punch unit 300 in more detail.

First Sheet Conveying Operation

Figure 2:
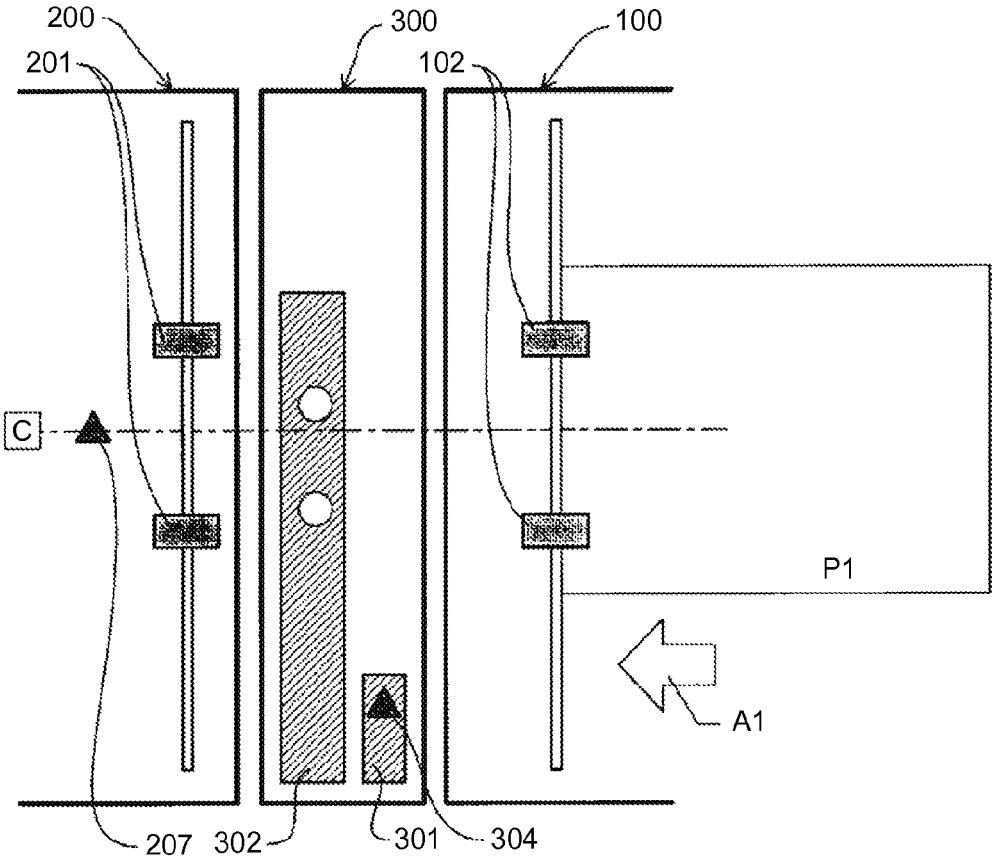
FIG. 2 is a plan view of a punch unit and portions of apparatuses ahead and behind in the embodiment, illustrating a condition of the leading edge of the first sheet reaching a pair of discharge conveying rollers.

FIG. 2 is a view illustrating a condition of the first sheet being conveyed from the image forming apparatus 100 and the leading end of the sheet reaching the pair of discharge conveying rollers 102. In FIGS. 2 to 5, the sign A1 represents sheet conveying operation, the sign C represents the center of layout, the sign P1 represents the first sheet, and the sign P2 represents the second sheet.

When the leading end of a sheet reaches the pair of discharge conveying rollers 102, a start conveying command is sent from the image forming apparatus 100 to the post-processing apparatus 200. With the start conveying command as a trigger, the post-processing apparatus 200 makes the pair of entrance rollers 201 and the pair of shift conveying rollers 204 rotate. The lateral registration detector 301 and the puncher 302 are standing by at the respective home positions. While the image forming apparatus 100 and the post-processing apparatus 200 are electrically connected by a serial communication line and exchange of information is performed by sending and receiving commands between them, the description thereof is omitted as it is not directly relevant to the present invention.

As in the foregoing, the pair of entrance rollers 201 is rotary driven by the entrance motor 216 and the pair of shift conveying rollers 204 is rotary driven by the discharging motor 217. Therefore, by the numbers of driving steps of both motors that are of stepping motors, it is possible to know the sheet position.

Figure 3:
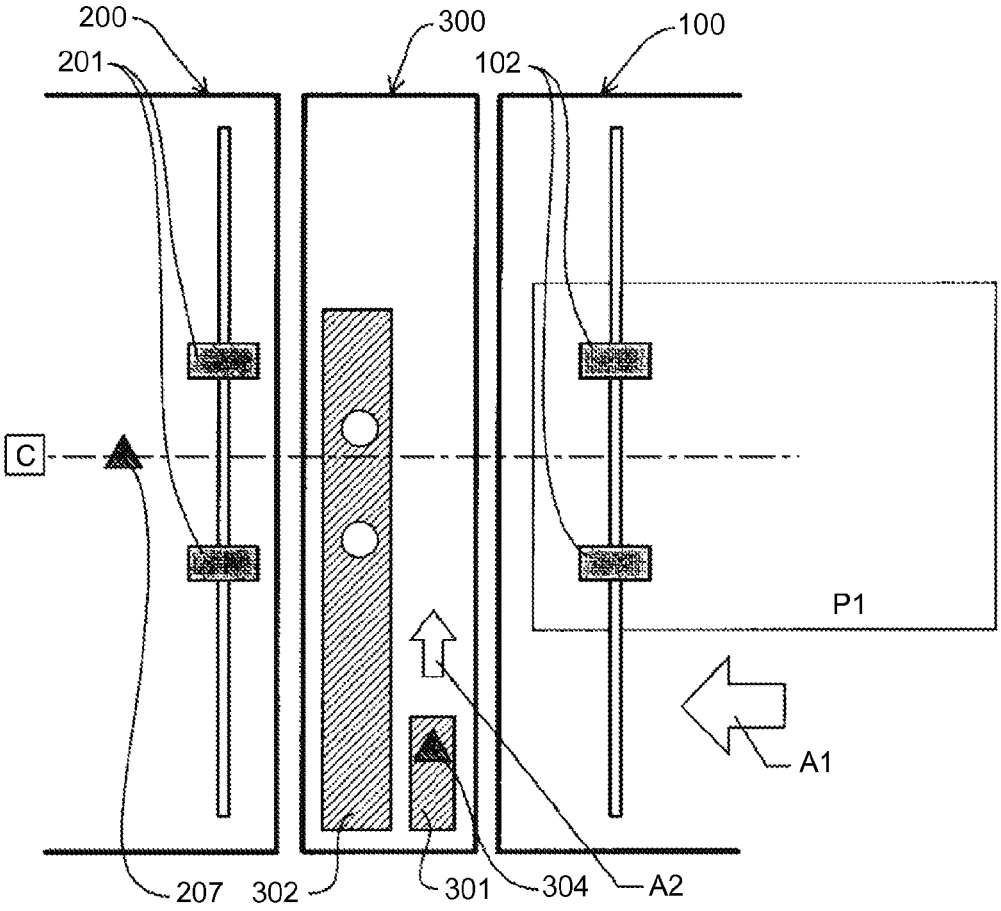
FIG. 3 is a plan view of the punch unit and portions of the apparatuses ahead and behind in the embodiment, illustrating a condition immediately before a lateral registration detector is moved in a direction towards a sheet from the home position.

When the sheet is conveyed to a given position, the lateral registration detector 301 is moved towards the direction of the sheet from the home position (sign A2 direction in FIG. 3). The timing T3 to start moving the lateral registration detector 301 is calculated as follows when a detecting point of the sheet edge portion by the lateral registration detecting sensor 304 is defined at a position 70.0 millimeters from the trailing end of the sheet.

(1) A time T1 required for the lateral registration detector 301 to detect an edge face of the sheet from the home position is calculated by the following Equation (1).

$$T1=\{Dc-(Lw/2)\}/Vr1 \quad (1)$$

Dc: distance from the home position of the lateral registration detector to the center of layout Lw: sheet width Vr1: moving speed (high speed) of the lateral registration detector 301

(2) A time T2 for the position 70.0 millimeters from the trailing end of the sheet to reach the lateral registration detecting sensor 304 (position in conveying direction)

from receiving the start conveying command is calculated by the following Equation (2).

$$T2=(Dr+Lp-70.0)/Vp \quad (2)$$

Dr: distance (in conveying direction) from the pair of discharge conveying rollers 102 to the lateral registration detecting sensor 304

Lp: sheet length

Vp: sheet conveying speed (3) A time T3 for the lateral registration detector 301 to start operating from receiving the start conveying command is calculated by the following Equation (3).

$$T3=T2-T1 \quad (3)$$

Accordingly, the lateral registration detector 301 starts to move when the time T3 thus calculated elapses from receiving the start conveying command.

Figure 4:
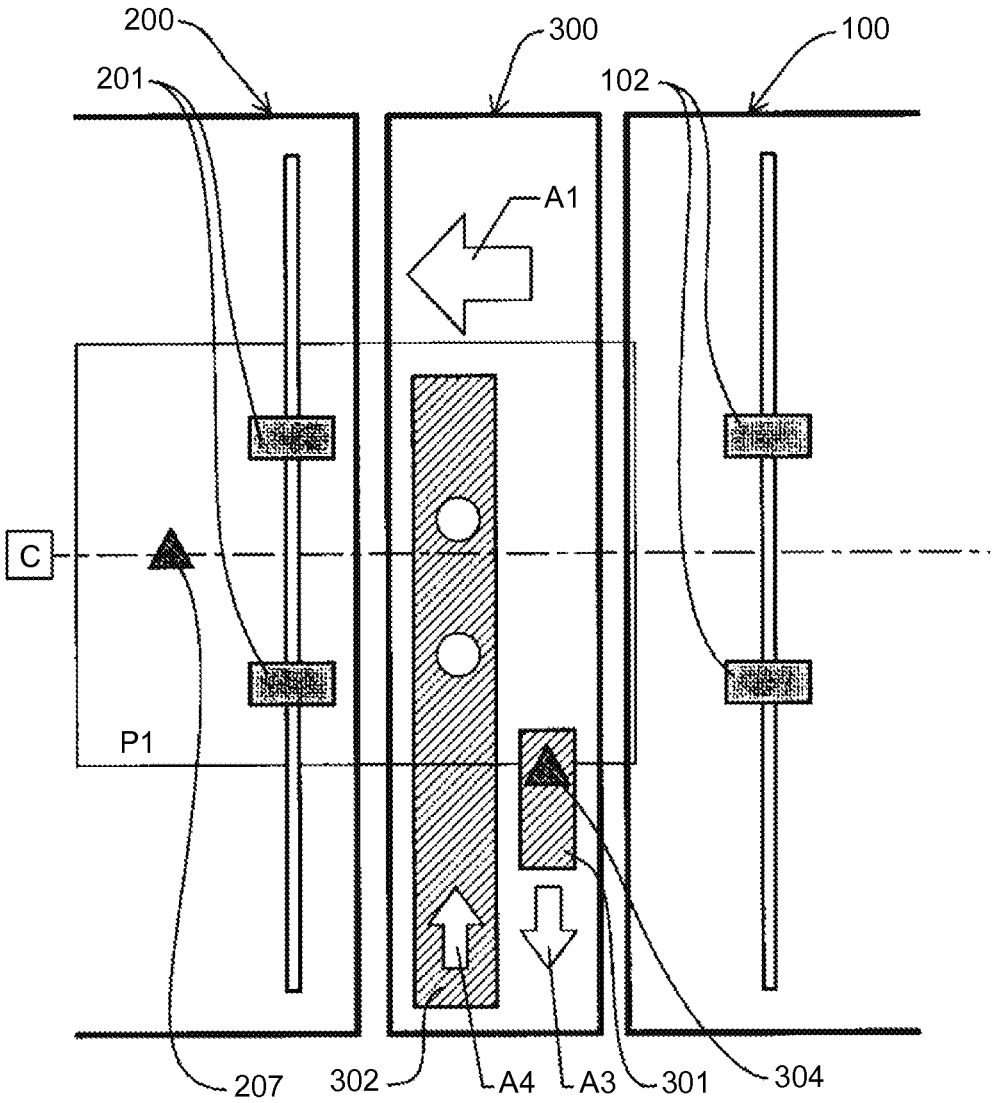
FIG. 4 is a plan view of the punch unit and portions of the apparatuses ahead and behind in the embodiment, illustrating a condition at the timing of a sheet edge portion being detected by the lateral registration detector.

FIG. 4 is a view illustrating a condition at the timing of the sheet edge portion being detected by the lateral registration detecting sensor 304. When the sheet edge portion is detected, the lateral registration detector 301 stops and moves back in the direction towards the home position (A3 direction in FIG. 4). Furthermore, the puncher 302 moves in a direction of the sign A4. The moving distance Ly of the puncher 302 at this time is calculated as follows.

(1) A lateral registration (lateral deviation) Lx of the sheet is calculated by the following Equation (4).

$$Lx=Dc-(Lw/2)-Lr \quad (4)$$

Dc: distance from the home position of the lateral registration detector to the center of layout Lw: sheet width Lr: moving distance of the lateral registration detector 301 from the home position of the lateral registration detector until the detection of sheet edge portion (2) A moving distance Ly of the puncher 302 from the home position is calculated by the following Equation (5).

$$Ly=Dp+Lx \quad (5)$$

Dp: distance from the home position of the puncher to the center of layout

In the above-described Equation (4), when the lateral registration (lateral deviation) amount Lx of the sheet has a positive value, the sheet is displaced in the direction of A4 in FIG. 4 from the center of layout, and when Lx has a negative value, the sheet is displaced in the A3 direction.

The puncher 302 stops when moved by Ly, and waits for the sheet to stop at the punching position. When the sheet is further conveyed and the position of the sheet 12 millimeters from its trailing end reaches the center of the puncher 302, i.e., directly underneath punch blades, the conveyance of sheet is stopped and the punching operation by the puncher 302 is performed. When the punching is completed, the conveyance of the sheet is resumed and the puncher 302 returns to the home position.

Second and Subsequent Sheet Conveying Operation

Figure 5:
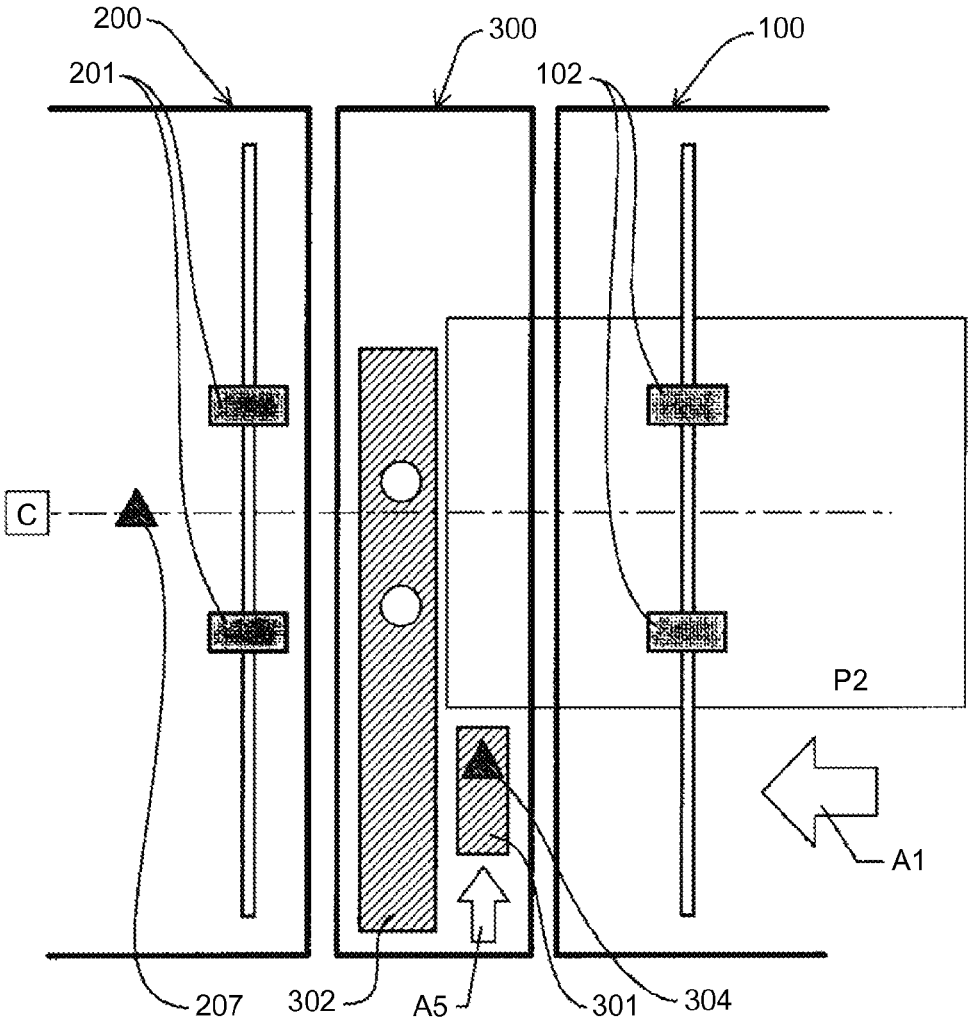
FIG. 5 is a plan view of the punch unit and portions of the apparatuses ahead and behind in the embodiment, illustrating a condition immediately before the lateral registration detector is moved in the direction towards the sheet for the second sheet.

Subsequently, when the second sheet P2 is conveyed from the image forming apparatus 100 and the leading end of the sheet reaches the pair of discharge conveying rollers 102, the lateral registration detector 301 moves in a direction of A5 in FIG. 5 from the home position. At this time, the lateral registration detector 301 moves up to near the sheet edge, and thus the moving distance of the lateral registration detector 301 is calculated as follows.

(1) A moving distance Lz of the lateral registration detector 301 from the home position is calculated by the following Equation (6).

$$Lz=Lr-Ln \quad (6)$$

Lr: moving distance of the lateral registration detector 301 from the home position until the detection of the sheet edge portion of the first sheet Ln: retracting distance of the lateral registration detector 301 from the edge face of the sheet The position at which the lateral registration detector 301 is moved by Lz is the standby position of the lateral registration detector 301. When the sheet is further conveyed, and when the sheet is conveyed by a given distance from the entrance sensor 207 being turned on, the lateral registration detector 301 moves in the direction towards the sheet from the standby position. The timing to start moving the lateral registration detector 301 at this time is calculated as follows when the detecting point of the sheet edge portion by the lateral registration detecting sensor 304 is defined as the position 70.0 millimeters from the trailing end of the sheet.

(1) A time T4 required for the lateral registration detector 301 to detect an edge face of the sheet from the standby position is calculated by the following Equation (7).

$$T4=Ln/Vr2 \quad (7)$$

Ln: retracting distance of the lateral registration detector 301 from the edge face of the sheet Vr2: moving speed (low speed) of the lateral registration detector 301

(2) A time T5 for the position 70.0 millimeters from the trailing end of the sheet to reach the lateral registration detecting sensor 304 (position in conveying direction) from the entrance sensor 207 being turned on is calculated by the following Equation (8).

$$T5=(Lp-De-70.0)/Vp \quad (8)$$

Lp: sheet length P0 De: distance (in conveying direction) from the entrance sensor 207 to the lateral registration detecting sensor 304

Vp: sheet conveying speed (3) A time T6 for the lateral registration detector 301 to start operating from the entrance sensor 207 being turned on is calculated by the following Equation (9).

$$T6=T5-T4 \quad (9)$$

Accordingly, the lateral registration detector 301 starts to move when the time T6 thus calculated elapses from the entrance sensor 207 being turned on.

As for the second and subsequent sheets, because the lateral registration detector 301 is standing by near the sheet edge portion and the time to detect the edge face of the sheet is short, the moving speed of the lateral registration detector 301 is set to a lower speed as compared with that for the first sheet (Vr1>Vr2).

Thereafter, as the same as that for the first sheet, retuning of the lateral registration detector 301 to the home position, calculation of moving distance of the puncher 302 and the moving thereof, punching of the sheet, and returning of the puncher 302 to the home position are performed in sequence, and conveying of the sheet is further continued.

Figure 6:
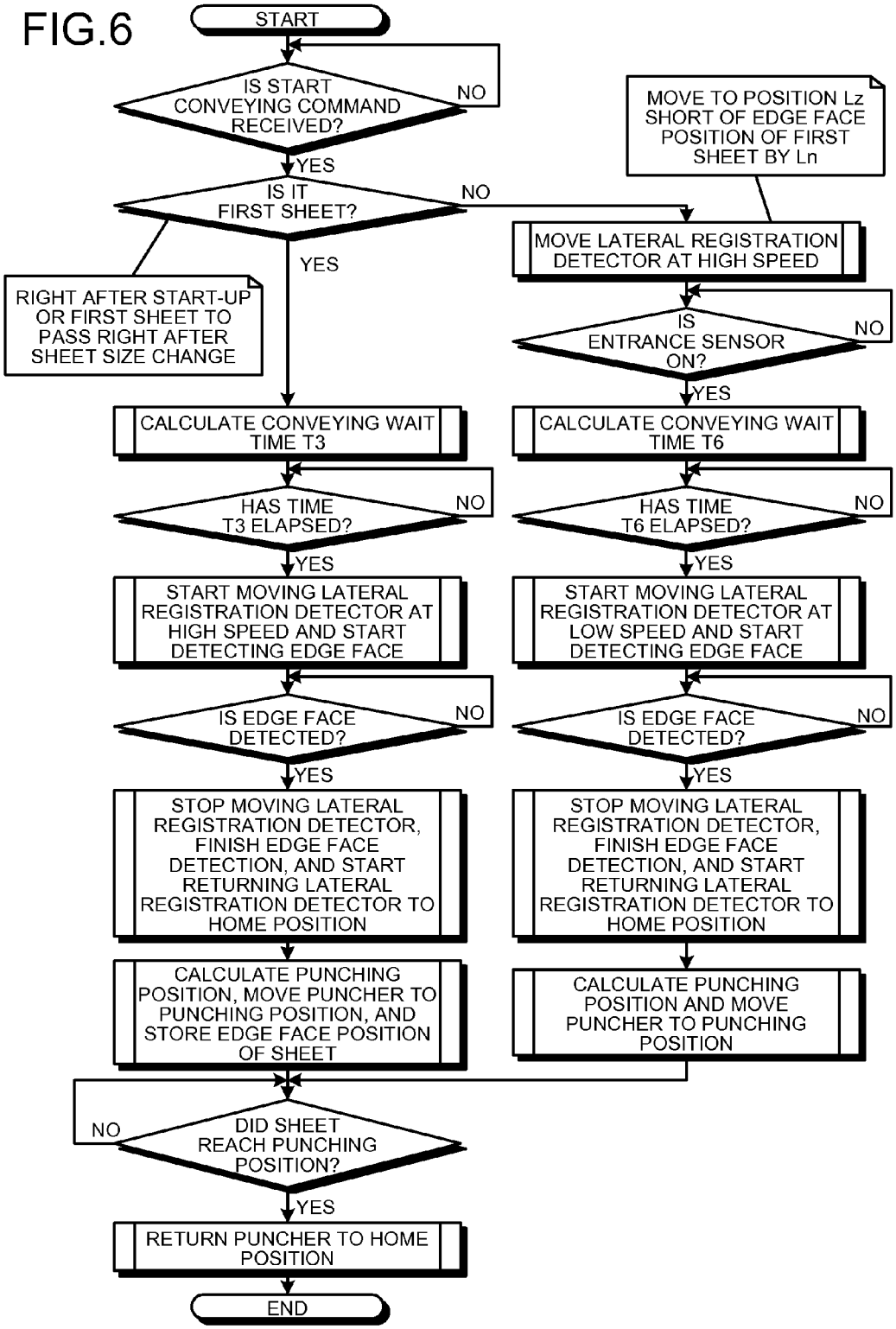
FIG. 6 is a flowchart illustrating operations performed in punching in the embodiment.

FIG. 6 is a flowchart illustrating the control from the detection of an edge face of a sheet to the punching operation. When a user sets a document to a scanning unit of the image forming apparatus 100 and starts copying, at the same time as scanning the document, the image forming apparatus 100 sends a receiving preparation command to the post-processing apparatus 200. In the post-processing apparatus 200, when the receiving preparation command is received, homing operations, moving operations of receiving position, and such of load necessary for post-processing are performed as the receiving preparation.

When the post-processing apparatus 200 notifies the image forming apparatus 100 of the completion of receiving preparation, started is a copying operation by the image forming apparatus 100 in which image forming, transferring and fixing of an image to a sheet, and such are performed, and the sheet is then conveyed towards the post-processing apparatus 200. When the sheet reaches the pair of discharge conveying rollers 102, a start conveying command is sent as in the foregoing. In addition, a sheet size command defined by the sheet length and the sheet width is sent along.

Whether a sheet conveyed is the first sheet or the second or subsequent sheet is determined as follows. At the time of receiving the start conveying command, when the following two patterns apply, the sheet conveyed is determined as the first sheet and a subsequent sheet is determined as the second or subsequent sheet.

Pattern 1: when the first start conveying command is received after receiving a receiving preparation command Pattern 2: when a sheet size command received is different from that of the previous sheet As in the foregoing, for the first sheet, regardless of its sheet size (width), the lateral registration detector 301 is moved in the direction towards the edge face of the sheet from the home position to detect the edge face of the sheet. With lateral deviation in the sheet position corrected, punching is performed by the puncher 302. For the second and subsequent sheets, the lateral registration detector 301 is moved in advance to near the edge face of the sheet with reference to the detected position of the sheet edge of the first sheet, and the edge face is detected at a given timing. With the lateral deviation in the sheet position corrected, punching is performed by the puncher 302. Accordingly, without causing an increase in the size and complexity of the device or compromising the output speed of sheets (speed of the image forming process), punching can be performed by aligning the hole position with respect to the side edge of the sheet, and the power to move the lateral registration detector 301 is not wasted as much as possible.

In the sheet punching device according to claim 1, for the first sheet, regardless of the sheet size (width), a sheet edge detector is moved in a direction towards an edge face of the sheet from the home position to detect the edge face of the sheet. With the lateral deviation in the sheet position corrected, punching is performed. For the second and subsequent sheets, the sheet edge detector is moved in advance to near the edge face of the sheet with reference to the detected position of the sheet edge of the first sheet, and the edge face is detected at a given timing. With lateral deviation in the sheet position corrected, punching is performed by the punching unit. Accordingly, without causing an increase in the size and complexity of the device or compromising the output speed of sheets (speed of the image forming process), punching can be performed by aligning the hole position with respect to the side edge of the sheet, and the power to move the sheet edge detector is not wasted as much as possible.

In the sheet punching device according to claim 2, in addition to the effects achieved according to claim 1, the timing to start operating is calculated from a sheet length and a sheet conveying speed. Therefore, even when the size and the conveying speed of the sheet conveyed from the main body are changed, the sheet edge can be detected at an appropriate timing.

In the sheet punching device according to claim 3, in addition to the effects achieved according to claim 1 or 2, the moving speed of the sheet edge detector is set slower for detecting the sheet edge portion of the second or subsequent sheet. Therefore, an unnecessary drive operation to make the sheet edge detector operate faster than necessary is eliminated.

In the sheet punching device according to claim 4, in addition to the effects achieved according to claim 1, the detection of sheet edge can be made from near the sheet, whereby the sheet edge can be detected more accurately.

In the image forming system according to claim 5, the effects achieved according to any one of claims 1 to 4 can be achieved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet punching device, comprising:

a punching unit configured to perform punching on a sheet;

a sheet edge detector configured to detect an edge portion of the sheet in parallel with a conveying direction of the sheet;

a moving unit configured to move the punching unit and the sheet edge detector each in a direction intersecting the sheet conveying direction; and an entrance sensor, disposed downstream of the sheet edge detector in the conveyance direction of the sheet, configured to detect a leading end and a trailing end of the sheet to perform respective sheet process timings in conjunction with the sheet edge detector, wherein in an operation of detecting an edge portion of a sheet when the punching unit performs the punching on the sheet, the sheet edge detector is moved in a direction towards the sheet from a home position at a given timing without stopping to detect an edge portion of a first sheet, and for second and subsequent sheets, the sheet edge detector is moved in advance to near a sheet edge portion of the second and subsequent sheets with reference to the detected position of the sheet edge of the first sheet as a standby position, at a given time.

2. The sheet punching device according to claim 1, wherein the timing to start operating the sheet edge detector for the first sheet is calculated from a sheet length and a sheet conveying speed.

3. The sheet punching device according to claim 1, wherein a moving speed of the sheet edge detector to detect the sheet edge portion is set slower for detecting the sheet edge portion of the second and subsequent sheets than for detecting the sheet edge portion of the first sheet.

4. The sheet punching device according to claim 1, wherein the moving of the sheet edge detector for the second and subsequent sheets is seven millimeters short of the detected position of the sheet edge portion of the first sheet.

5. An image forming system comprising an image forming apparatus, a post-processing apparatus, and a sheet punching device between the image forming apparatus and the post-processing apparatus, wherein the sheet punching device includes;

a punching unit configured to perform punching on a sheet, a sheet edge detector configured to detect an edge portion of the sheet in parallel with a conveying direction of the sheet; and a moving unit configured to move the punching unit and the sheet edge detector each in a direction intersecting the sheet conveying direction; and an entrance sensor, disposed downstream of the sheet edge detector in the conveyance direction of the sheet, configured to detect a leading end and a trailing end of the sheet to perform respective sheet process timings in conjunction with the sheet edge detector, wherein in an operation of detecting an edge portion of a sheet when the punching unit performs the punching on the sheet, the sheet edge detector is moved in a direction towards the sheet from a home position at a given timing without stopping to detect an edge portion of a first sheet, and for second and subsequent sheets, the sheet edge detector is moved in advance to near a sheet edge portion of the second and subsequent sheets with reference to the detected position of the sheet edge of the first sheet as a standby position, at a given time.

6. The image forming system according to claim 5, wherein the timing to start operating the sheet edge detector for the first sheet is calculated from a sheet length and a sheet conveying speed.

7. The image forming system according to claim 5, wherein a moving speed of the sheet edge detector to detect the sheet edge portion is set slower for detecting the sheet edge portion of the second and subsequent sheets than for detecting the sheet edge portion of the first sheet.

8. The image forming system according to claim 5, wherein the moving of the sheet edge detector for the second and subsequent sheets is seven millimeters short of the detected position of the sheet edge portion of the first sheet.

9. A sheet punching device, comprising:

a punching unit configured to perform punching on a sheet; and a sheet edge detector configured to detect an edge portion of the sheet in parallel with a conveying direction of the sheet; and a moving unit configured to move the punching unit and the sheet edge detector each in a direction intersecting the sheet conveying direction; and an entrance sensor, disposed downstream of the sheet edge detector in the conveyance direction of the sheet, configured to detect a leading end and a trailing end of the sheet to perform respective sheet process timings in conjunction with the sheet edge detector, wherein in an operation of detecting an edge portion of a sheet when the punching unit performs the punching on the sheet, the sheet edge detector is moved in a direction towards the sheet from a home position at a given timing and without stopping to detect an edge portion of a first sheet, and for second and subsequent sheets, the sheet edge detector is moved in advance to near a sheet edge portion of the second and subsequent sheets with reference to the detected position of the sheet edge of the first sheet, at a given time, wherein a moving speed of the sheet edge detector to detect the sheet edge portion is set slower for detecting the sheet edge portion of the second and subsequent sheets than for detecting the sheet edge portion of the first sheet.

10. An image forming system comprising an image forming apparatus, a post-processing apparatus, and a sheet punching device between the image forming apparatus and the post-processing apparatus, wherein the sheet punching device includes;

a punching unit configured to perform punching on a sheet, and a sheet edge detector configured to detect an edge portion of the sheet in parallel with a conveying direction of the sheet; and a moving unit configured to move the punching unit and the sheet edge detector each in a direction intersecting the sheet conveying direction; and an entrance sensor, disposed downstream of the sheet edge detector in the conveyance direction of the sheet, configured to detect a leading end and a trailing end of the sheet to perform respective sheet process timings in conjunction with the sheet edge detector, wherein in an operation of detecting an edge portion of a sheet when the punching unit performs the punching on the sheet, the sheet edge detector is moved in a direction towards the sheet from a home position at a given timing without stopping to detect an edge portion of a first sheet, and for second and subsequent sheets, the sheet edge detector is moved in advance to near a sheet edge portion of the second and subsequent sheets with reference to the detected position of the sheet edge of the first sheet, at a given time, wherein a moving speed of the sheet edge detector to detect the sheet edge portion is set slower for detecting the sheet edge portion of the second and subsequent sheets than for detecting the sheet edge portion of the first sheet.

* * * * *